US007407398B2

(12) United States Patent
Shishikura et al.

(10) Patent No.: US 7,407,398 B2
(45) Date of Patent: Aug. 5, 2008

(54) LEVER TYPE ELECTRICAL CONNECTOR

(75) Inventors: Seiji Shishikura, Chiba (JP); Kazushige Sakamaki, Tokyo (JP); Yoshiro Kakuda, Toyota (JP)

(73) Assignees: Tyco Electronics AMP K.K., Kanagawa-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/854,593

(22) Filed: Sep. 13, 2007

(65) Prior Publication Data

US 2008/0064242 A1 Mar. 13, 2008

(30) Foreign Application Priority Data

Sep. 13, 2006 (JP) ..... 2006-248396

(51) Int. Cl.
*H01R 13/62* (2006.01)

(52) U.S. Cl. ..... 439/157; 439/347

(58) Field of Classification Search ..... 439/157, 439/342, 347, 264, 268
See application file for complete search history.

(56) References Cited

U.S. PATENT DOCUMENTS

| | | | | |
|---|---|---|---|---|
| 2,987,693 | A * | 6/1961 | Wamsley | 439/157 |
| 5,735,702 | A * | 4/1998 | Hio | 439/157 |
| 5,919,053 | A * | 7/1999 | Tsuji et al. | 439/157 |
| 5,964,602 | A * | 10/1999 | Aoki et al. | 439/157 |
| 6,183,276 | B1 * | 2/2001 | Tsuji et al. | 439/157 |
| 6,361,334 | B1 * | 3/2002 | Konoya et al. | 439/144 |
| 6,641,423 | B1 * | 11/2003 | Giro | 439/347 |
| 6,755,674 | B2 * | 6/2004 | Fujii et al. | 439/157 |
| 6,971,894 | B2 * | 12/2005 | Dillon et al. | 439/157 |
| 7,004,769 | B1 * | 2/2006 | Putnam et al. | 439/157 |
| 7,044,758 | B2 * | 5/2006 | Deno et al. | 439/157 |
| 7,052,293 | B2 * | 5/2006 | Koshy et al. | 439/157 |
| 2005/0221647 | A1 * | 10/2005 | Dillon et al. | 439/157 |
| 2006/0040533 | A1 * | 2/2006 | Koshy et al. | 439/157 |
| 2006/0040534 | A1 * | 2/2006 | Flowers | 439/157 |
| 2006/0040535 | A1 * | 2/2006 | Koshy et al. | 439/157 |
| 2006/0040536 | A1 * | 2/2006 | Putnam et al. | 439/157 |
| 2006/0228921 | A1 * | 10/2006 | Fukui et al. | 439/157 |
| 2007/0087599 | A1 * | 4/2007 | Sasaki et al. | 439/157 |
| 2007/0099461 | A1 * | 5/2007 | Pittenger et al. | 439/157 |

FOREIGN PATENT DOCUMENTS

| | | |
|---|---|---|
| JP | 11-250985 | 9/1999 |

* cited by examiner

*Primary Examiner*—Tulsidas C. Patel
*Assistant Examiner*—Harshad C Patel
(74) *Attorney, Agent, or Firm*—Barley Snyder LLC

(57) ABSTRACT

A lever type electrical connector includes an insulating housing provided with a least one terminal and a mating face that receives a complementary mating connector. A cam plate is arranged on the insulating housing and is moveable in a sliding direction substantially perpendicular to a mating direction of the complementary mating connector. A lever is mounted on the insulating housing. The lever has a shaft extending substantially perpendicular to the sliding direction and the mating direction and is rotatable about the shaft between an open position and a closed position to move the cam plate in the sliding direction. An elastically deformable bearing section is provided on the insulating housing and supports the shaft. A reinforcement member is removably attached to the bearing section and abuts the bearing section such that the reinforcement member receives a force applied from the shaft to the bearing section when the lever is rotated.

10 Claims, 11 Drawing Sheets

LEVER TYPE ELECTRICAL CONNECTOR

CROSS-REFERENCE TO RELATED APPLICATIONS

This application claims the benefit of the filing date under 35 U.S.C. § 119(a)-(d) of Japanese Patent Application No. 2006-248396, filed Sep. 13, 2006.

FIELD OF THE INVENTION

The present invention relates to a lever type electrical connector including an insulating housing provide with a cam plate and a lever wherein the lever actuates the cam plate to connect and disconnect a complimentary mating connector from the insulating housing.

BACKGROUND

In an electrical connector where multiple contacts are simultaneously contacted, the amount of force required for connecting and disconnecting the connector with a complementary mating connector increases with multi-polarization. Thus, it is known to provide the connector with a lever for assisting in the connection and disconnection of the complementary mating connector from the connector. An example of such a connector is illustrated and described in Japanese Patent Application Publication No. H11-250985.

A lever type electrical connector has, for example, a housing that engages with a complementary mating connector. A sliding member having a cam face abutting a cam follower of the complementary mating connector is slidably mounted to the housing. A lever moves pivotally around a rotation shaft to slide the sliding member. The lever and the sliding member having the cam face constitute a force-doubling mechanism that reduces the force needed for connecting and disconnecting the complementary mating connector. When the lever is operated, the lever slides the sliding member. As a result, the complementary mating connector is pulled into the housing by an amplified force. Accordingly, the connector and the complementary mating connector are mated. On the other hand, when the lever is operated to move pivotally in an opposite direction, the complementary mating connector is pushed away from the connector in a direction in which the complementary mating connector separates from the housing. Accordingly, the complementary mating connector is disconnected from the connector.

In the above-described connector, even in an irregular mating state in which the positioning of the complementary mating connector with the connector is incomplete or a foreign substance is inserted therein, the operating force of the lever is not always large enough to make the lever difficult to be operated by an operator. Thus, an operator may not sense the irregular mating state and will still perform a forcible lever operation. If this occurs, a bearing section that supports a rotating shaft of the lever may receive an excessive force and thereby be damaged. In a case, where the bearing section is formed integrally with the housing, if the bearing section is damaged, the entire housing will need to be replaced. Thus, all electrical wires which connect the housing to a device at the time of the connecting operation will have to be re-wired to a new housing.

BRIEF SUMMARY

It is therefore at least one object of the present invention to provide a lever type electrical connector which is hard to damage when the lever is operated in an irregular mating state.

This and other objects are achieved by a lever type electrical connector comprising an insulating housing provided with a least one terminal. The insulating housing has a mating face that receives a complementary mating connector. At least one cam plate is arranged on the insulating housing. The cam plate is moveable in a sliding direction substantially perpendicular to a mating direction of the complementary mating connector. A lever is mounted on the insulating housing. The lever has a shaft extending substantially perpendicular to the sliding direction and the mating direction. The lever is rotatable about the shaft between an open position and a closed position to move the cam plate in the sliding direction. An elastically deformable bearing section is provided on the insulating housing and supports the shaft. A reinforcement member is removably attached to the bearing section. The reinforcement member abuts the bearing section such that the reinforcement member receives a force applied from the shaft to the bearing section when the lever is rotated.

BRIEF DESCRIPTION OF THE DRAWINGS

FIG. 7(*b*) is a top perspective view of the reinforcement member of the connector of FIG. 1.

FIG. 7(*c*) is a side view of the first embodiment of the reinforcement member of the connector of FIG. 1.

FIG. 8(*b*) is another bottom perspective view of the first embodiment of the reinforcement member of the connector of FIG. 1.

FIG. 10(*b*) is a cross-sectional view of the connector of FIG. 1 taken along line A-A of FIG. 10(*a*).

DETAILED DESCRIPTION OF THE EMBODIMENT(S)

Figure 1:
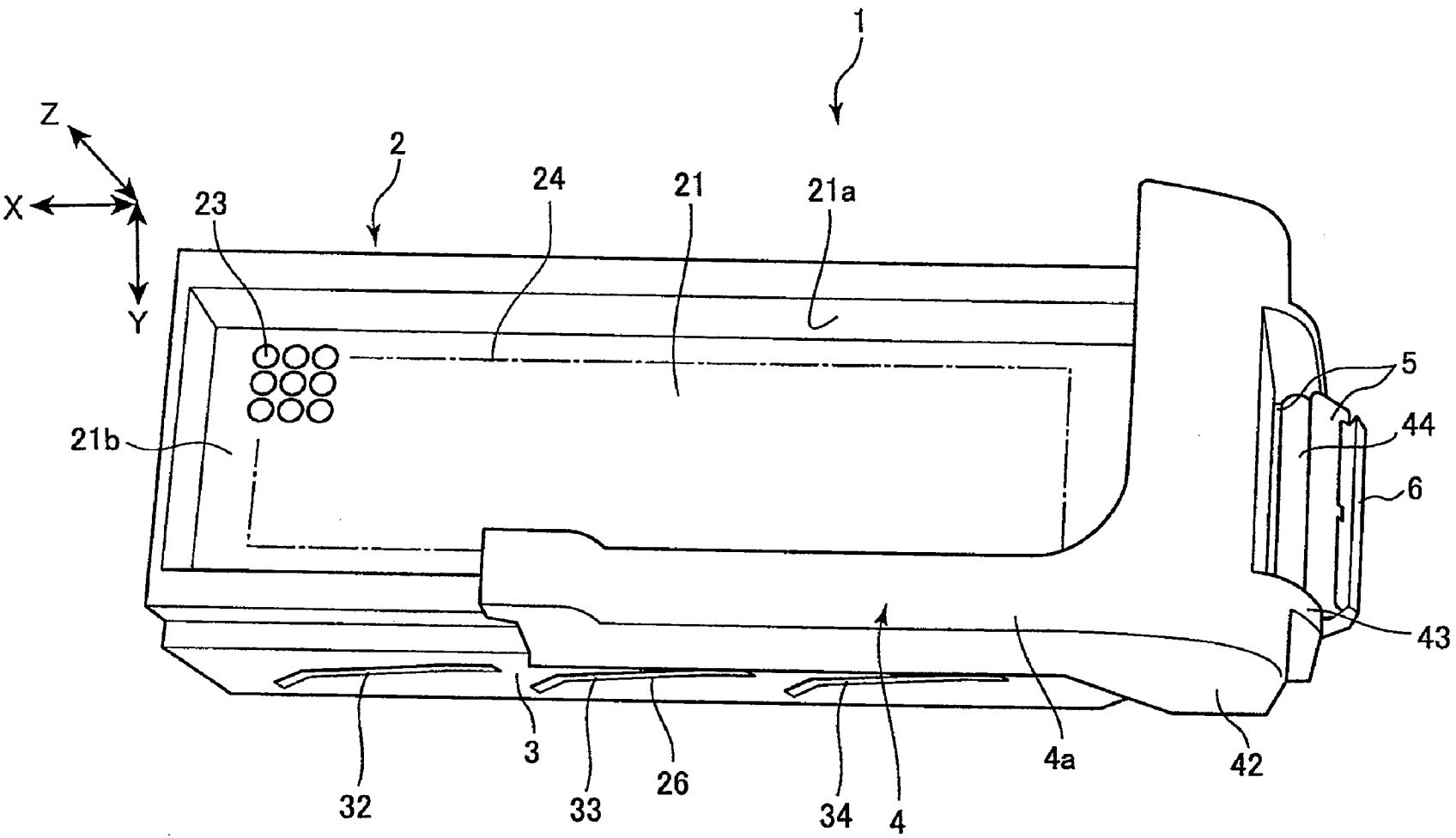
FIG. 1 is an obliquely upper perspective view of a lever type electrical connector according to a first embodiment of the present invention.
Figure 2:
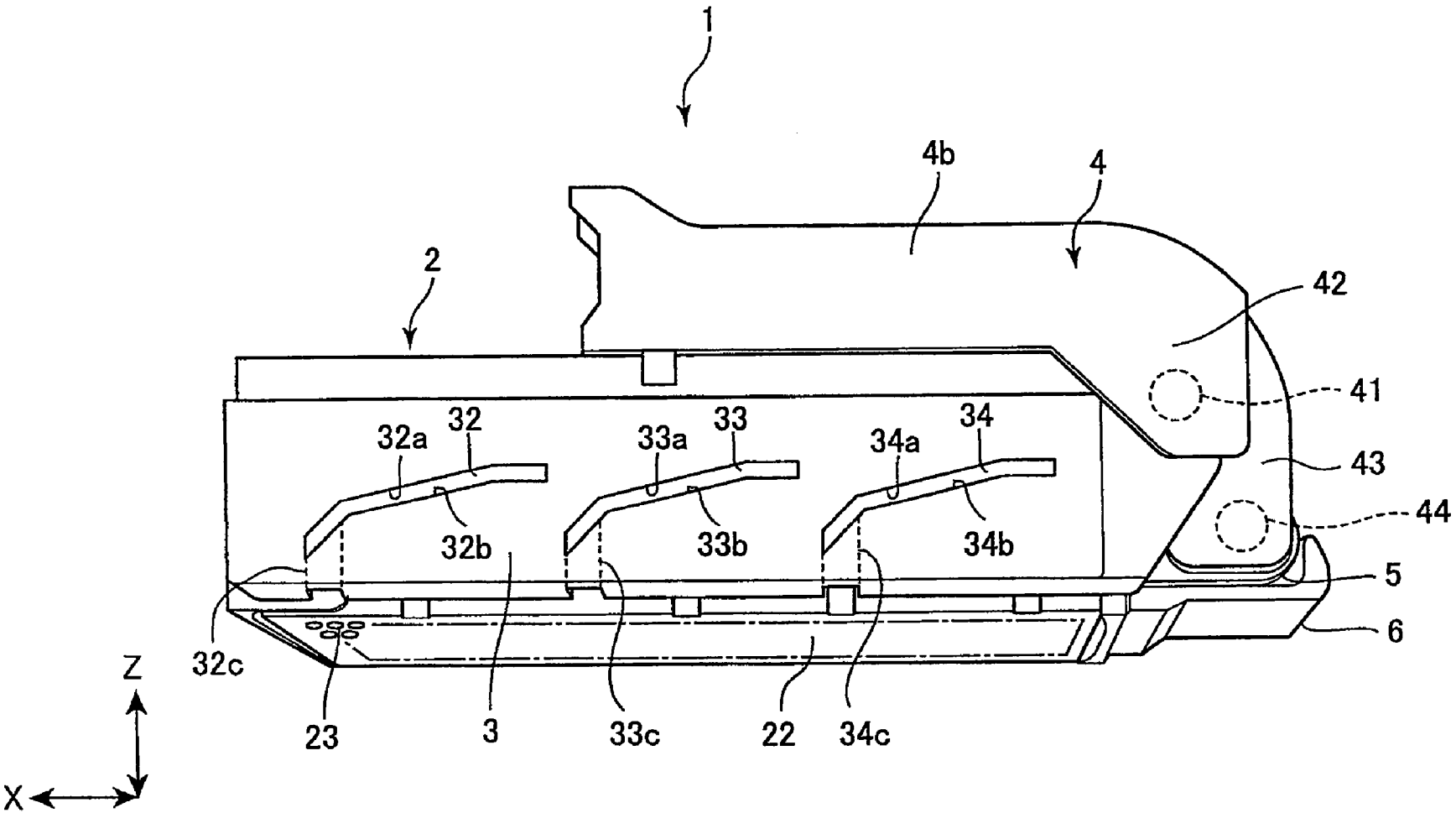
FIG. 2 is an oblique side perspective view of the connector of FIG. 1 showing a lever of the connector in a closed position.
Figure 3:
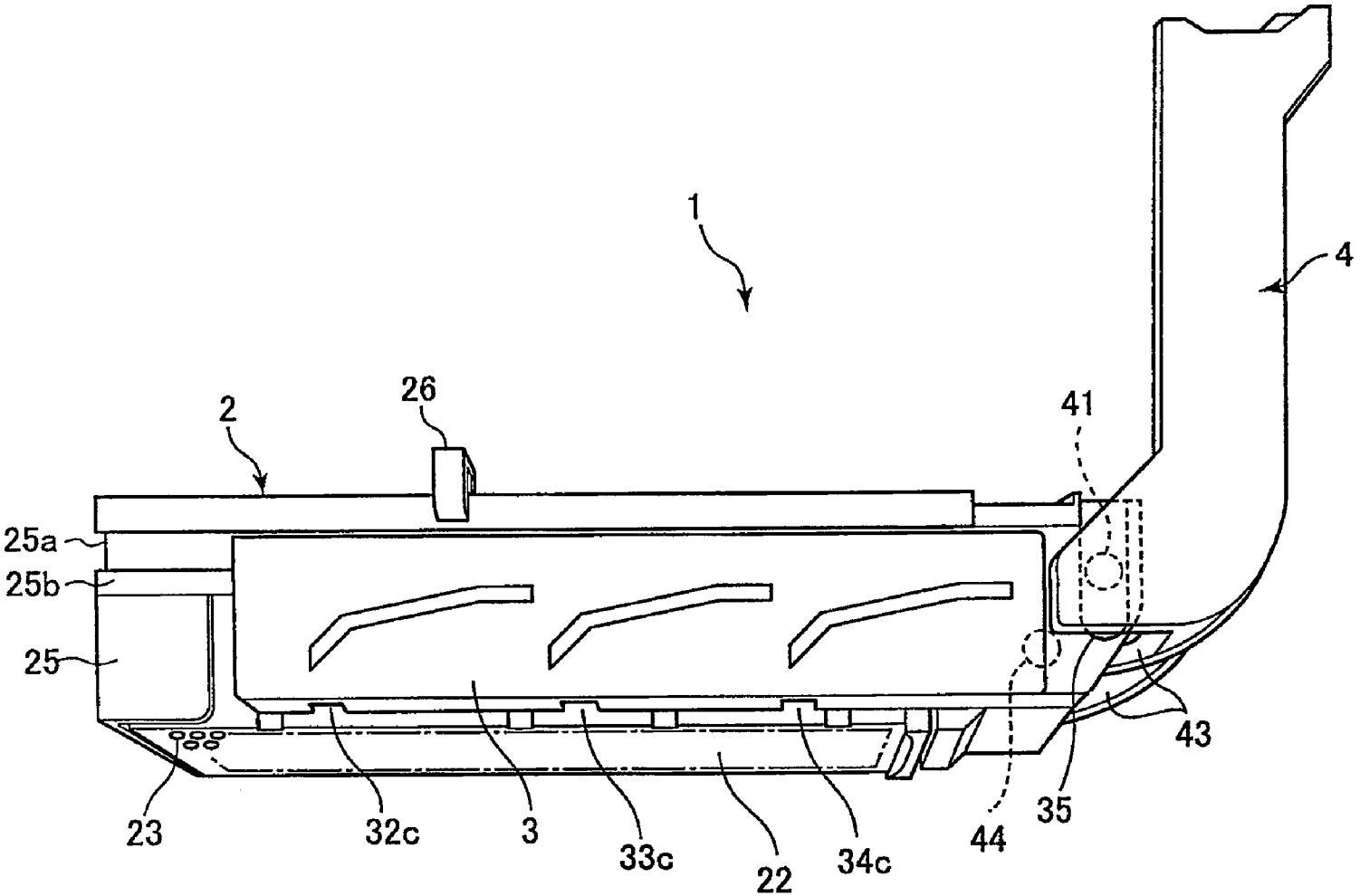
FIG. 3 is a perspective view of the connector of FIG. 1 showing the lever of the connector in an open position.
Figure 4:
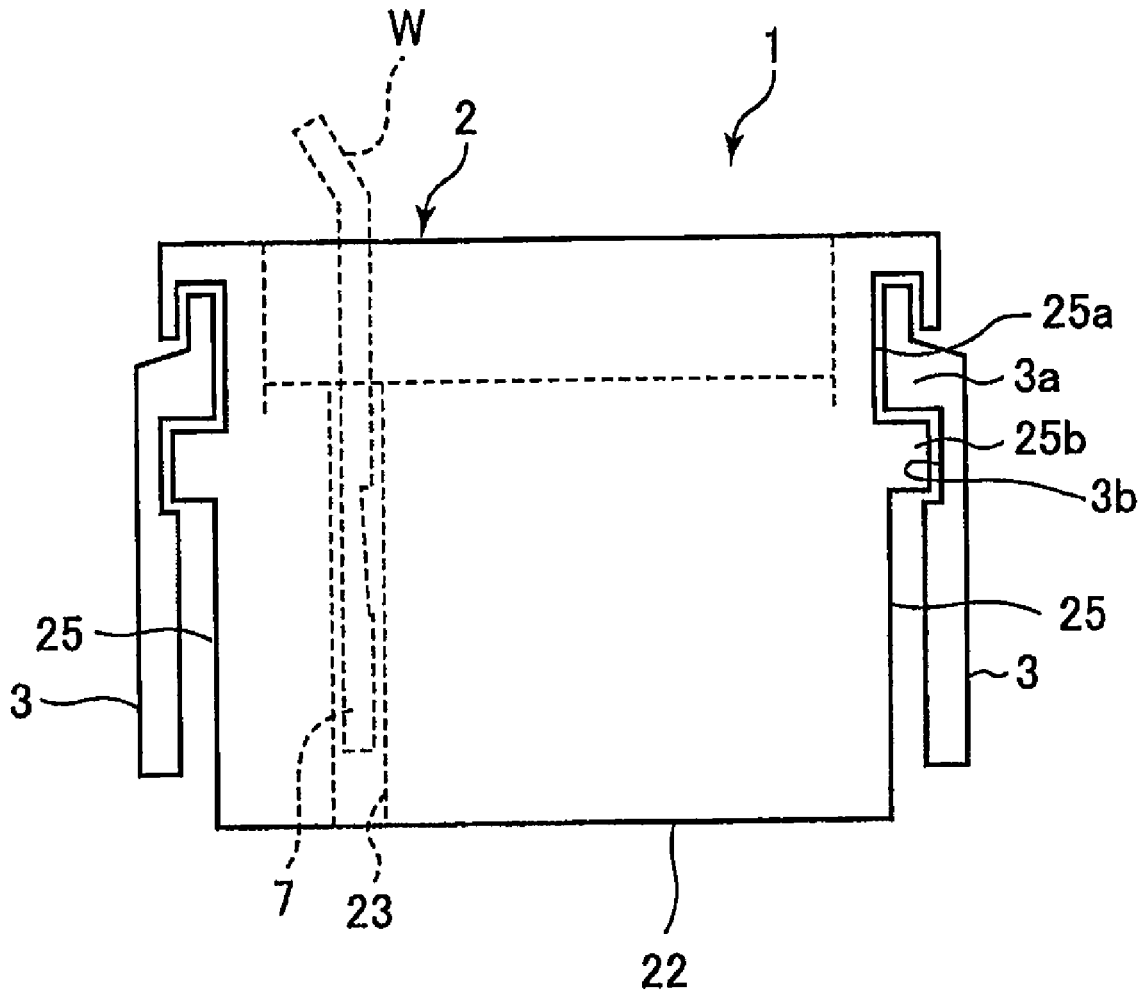
FIG. 4 is an end view showing the connector of FIG. 1 with the lever omitted.

As shown in FIG. 1, a lever type electrical connector 1 according to a first embodiment of the invention includes an insulating housing 2, cam plates 3, a lever 4, a bearing section 5, and a reinforcement section 6. The insulating housing 2 has a substantially rectangular parallelepiped shape. As shown in FIG. 4, the insulating housing 2 has side walls 25. In top portions of the side walls 25 are formed sliding grooves 25*a*. The sliding grooves 25*a* have a substantially L-shaped cross section and extend in a sliding direction X (FIG. 2). Ridges 25*b* are formed substantially under and adjacent to the sliding grooves 25*a*. As shown in FIG. 3, the insulating housing 2 has a lever engagement member 26.

Figure 11:
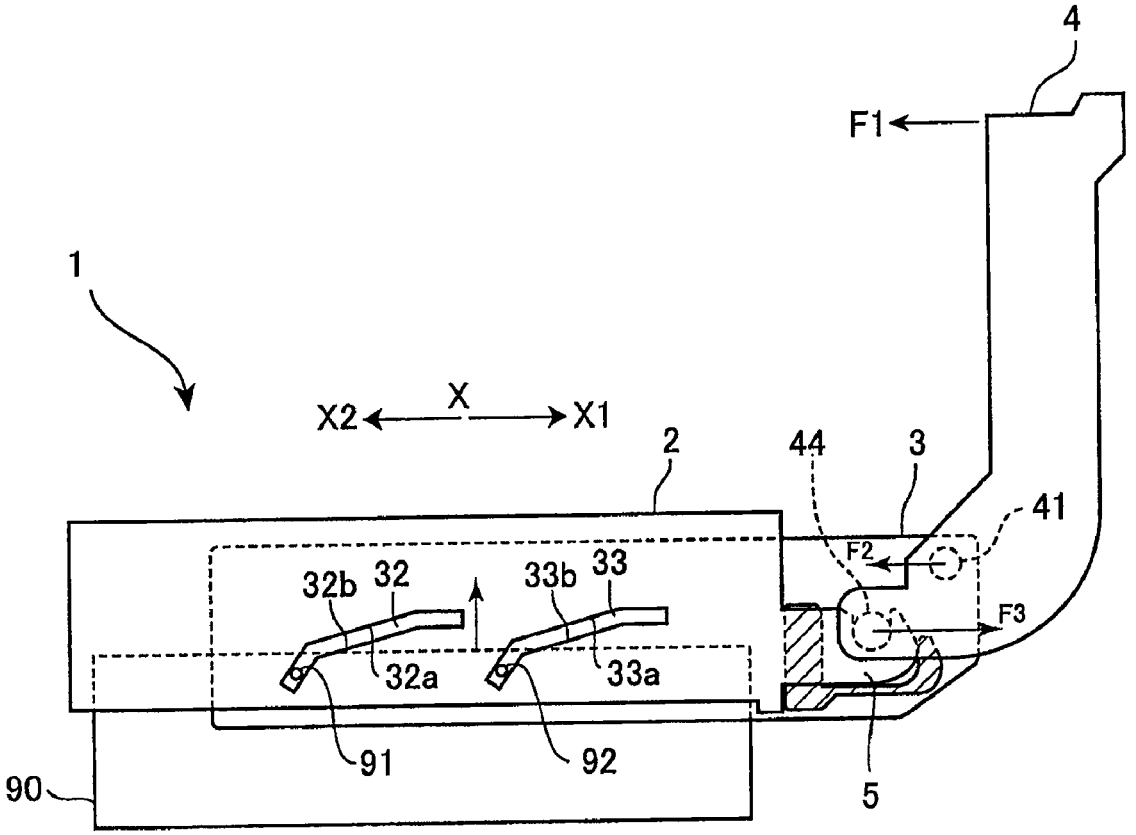
FIG. 11 is a partial cross-sectional view of the connector of FIG. 1 showing the connector in a state in which it is to be engaged with a complementary mating connector.

As shown in FIG. 1, a concave section 21 is formed in an upper portion of the insulating housing 2. The concave section 21 includes an inner wall 21*a* along an external form of the insulating housing 2. A bottom face 21*b* of the concave section 21 is provided with terminal housing openings 23. The terminal housing openings 23 extend from the bottom face 21*b* of the concave section 21 to a mating face 22 (FIG. 2) on a bottom portion of the insulating housing 2. The terminal housing openings 23 are substantially arranged in a matrix within an area 24 (illustrated by dashed lines) of the bottom face 21*b*. As shown in FIG. 4, terminals 7 are arranged in each of the terminal housing openings 23. An electrical wire W is crimped to each of the terminals 7. Each of the terminals 7 is connected to a mating terminal (not shown) of a complementary mating connector 90 (FIG. 11).

As shown in FIG. 2, the mating face 22 is formed on the bottom portion of the insulating housing 2. The complementary mating connector 90 (FIG. 11) is connected to and disconnected from the connector 1 via the mating face 22. The complementary mating connector 90 (FIG. 11) is connected and disconnected from the mating face 22 in a mating direction Z. The insulating housing 2 has a width in a direction Y is substantially perpendicular to the mating direction Z and the sliding direction X.

As shown in FIG. 4, the cam plates 3 are arranged on both sides of the insulating housing 2 and are configured to slide in the sliding direction X in a longitudinal direction of the insulating housing 2 in response to movement of the lever 4. Top portions 3*a* of the cam plates 3 have a substantially L-shaped cross section corresponding to the cross section of the sliding grooves 25*a*. Adjacent to the top portions 3*a* and formed in the L-shaped cross section are grooves 3*b*. The grooves 3*b* have a shape corresponding to the ridges 25*b*. The sliding grooves 25*a* of the insulating housing 2 are engaged with the top portions 3*a* of the cam plates 3 and the ridges 25*b* are engaged with the grooves 3*b* so that the cam plates 3 are slidably held by the insulating housing 2.

As shown in FIG. 2, cam slots 32, 33, 34 extending substantially obliquely are formed in the cam plates 3. Cam faces 32*a*, 33*a*, 34*a*, 32*b*, 33*b*, 34*b* are formed in an upper side face and a lower side face of each of the cam slots 32, 33, 34, respectively. Guide grooves 32*c*, 33*c*, 34*c* connect to the cam slots 32, 33, 34, respectively. The guide grooves 32*c*, 33*c*, 34*c* extend to a bottom end of the cam plates 3. The guide grooves 32*c*, 33*c*, 34*c* are configured to guide projections 91, 92, 93 (FIG. 11) on the complementary mating connector 90 (FIG. 11) to the cam slots 32, 33, 34, respectively, when the complementary mating connector 90 (FIG. 11) is inserted in the insulating housing 2. The guide projections 91, 92, 93 (FIG. 11) guided to the cam slots 32, 33, 34 receive forces in the mating direction Z from the cam faces 32*b*, 33*b*, 34*b*, as the cam plates 3 slide in the sliding direction X. Accordingly, the complementary mating connector 90 (FIG. 11) is pulled into the insulating housing 2. As shown in FIG. 3, each end of the cam plates 3 has a groove 35 extending in substantially and up and down direction.

Figure 5:
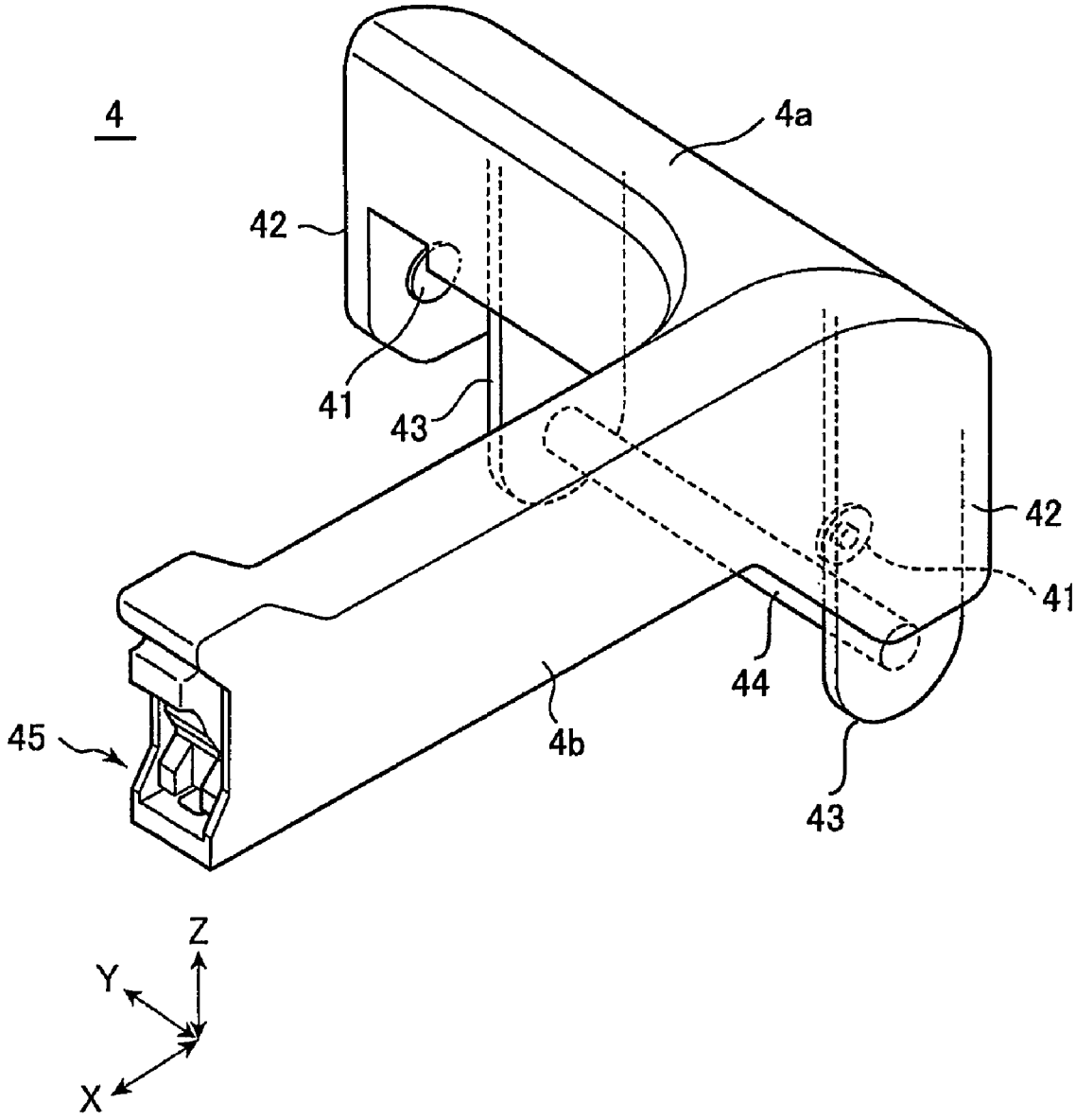
FIG. 5 is a perspective view of the lever of the connector of FIG. 1.

As shown in FIG. 5, the lever 4 includes a base section 4*a* extending in the direction Y and an arm 4*b* extending substantially in the sliding direction X. Both ends of the base section 4*a* have substantially plate-shaped base end sections 42 that substantially face each other. The base end sections 42 extend in a direction substantially perpendicular to the direction Y in which the base section 4*a* extends and the direction X in which the arm 4*b* extends. A slide shaft 41 is formed in the base end section 42. A slide shaft 41 is provided in the base section 4*a* and is configured to engage with the long groove 35 of the cam plates 3. Substantially plate-shaped supporting plates 43 are formed between the base end sections 42 and substantially face each other. A shaft 44 that is held by the bearing section 5 is provided between the supporting plates 43. A lock section 45 is formed in a tip portion of the arm 4*b*. The lock section 45 engages with the lever engagement member 26 (see FIG. 3) provided in the insulating housing 2 to lock the arm 4*b* in a closed state. The lever 4 supported in the bearing section 5 by the insulating housing 2 is pivotally moved by an operator between a closed position shown in FIG. 2 and an open position shown in FIG. 3 so that the lever 4 slides the cam plates 3 engaged with the sliding shaft 41 in the sliding direction X substantially perpendicular to the mating direction Z of the complementary mating connector 90 (FIG. 11).

Figure 6:
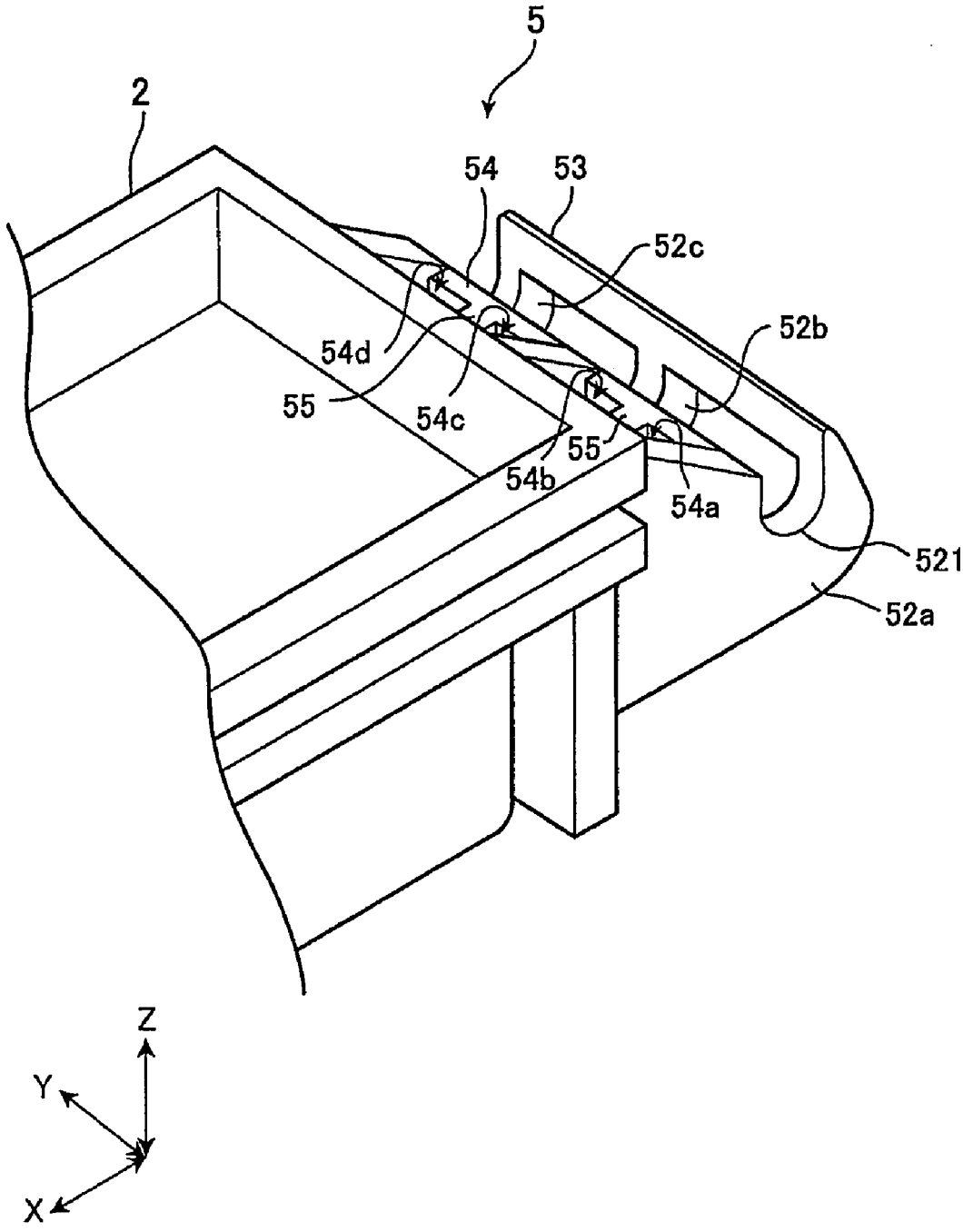
FIG. 6 is a perspective view of a bearing section of the connector of FIG. 1.

As shown in FIG. 6, one end of the insulating housing 2 is provided with the bearing section 5. The bearing section 5 may be formed on a resin material and may be integrally formed with the insulating housing 2. The bearing section 5 includes substantially plate-shaped ribs 52*a*, 52*b*, 52*c* that project from one end of the insulating housing 2 substantially in the sliding direction X and substantially parallel to each other. A first joining section 53 and a second joining section 54 combine the ribs 52 together. A notch 521 that receives the shaft 44 (FIG. 5) of the lever 4 is formed in each of the ribs 52*a*, 52*b*, 52*c*. The first joining section 53 combines tips of the ribs 52 projecting from the insulating housing 2. The second joining section 54 combines portions of the ribs 52 opposite to the first joining section 53 with respect to the notches 521. The first joining section 53 and the second joining section 54 substantially face each other with the notches 521 there between.

The shaft 44 of the lever 4 (FIG. 5) is elastically held between the first joining section 53 and the second joining section 54 in portions in which the notches 521 are provided so that the shaft 44 is arranged to be pivotally supported in a position in which the shaft is directed in the direction Y. A space between the first joining section 53 and the second joining section is slightly narrower than a diameter of the shaft 44 (see FIG. 5) of the lever 4. The ribs 52 are elastically deformed so that the space can be slightly widened. Accordingly, the shaft 44 of the lever 4 is mounted and dismounted from the bearing section 5 in the mating direction Z, which is substantially perpendicular to the sliding direction X and a radial direction of the shaft 44.

The bearing section 5 has assisting joining sections 55. The assisting joining sections 55 extend from the insulating housing 2 substantially between and substantially parallel to the ribs 52*a*, 52*b*, 52*c* and are combined with the second joining section 54. The bearing section 5 is provided with openings 54*a*, 54*b*, 54*c*, 54*d* that substantially extend in the mating direction Z. The openings 54*a*, 54*b*, 54*c*, 54*d* are substantially surrounded with the second joining section 54, the assisting joining sections 55, the ribs 52 and the insulating housing 2.

Figure 7A:
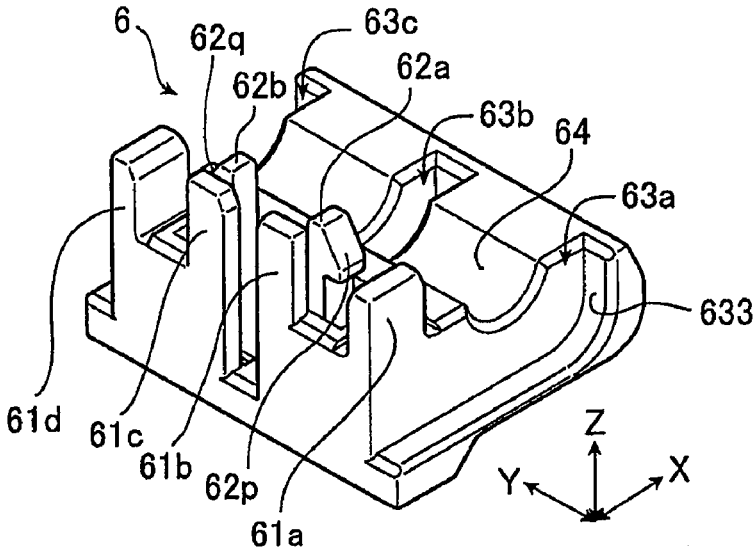
FIG. 7(*a*) is a bottom perspective view of a first embodiment of a reinforcement member of the connector of FIG. 1.
Figure 7B:
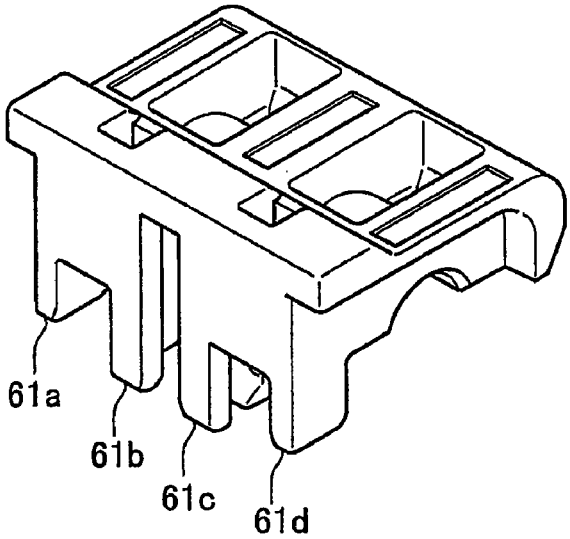
Figure 7C:
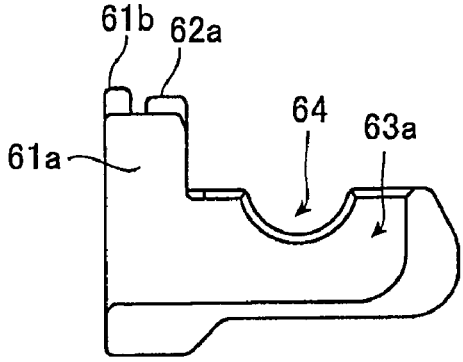

As shown in FIG. 7(*a*), the reinforcement member 6 includes fixing projections 61*a*, 61*b*, 61*c*, 61*d*, and a pair of elastically engaging projections 62*a*, 62*b*. The fixing projections 61*a*, 61*b*, 61*c*, 61*d* are configured for insertion in the openings 54*a*, 54*b*, 54*c*, 54*d*, respectively. The elastically engaging projections 62*a*, 62*b* are configured for insertion in the openings 54*b*, 54*c*, respectively, and are engaged with the assisting joining section 55. Lock claws 62*p*, 62*q* are provided on tips of the elastically engaging projections 62*a*, 62*b*, respectively. The lock claws 62*p*, 62*q* are provided on sides of the tips of the elastically engaging projections 62*a*, 62*b*, such that the lock claws 62*p*, 62*q* are opposed to each other in the direction Y (direction of the shaft 44 of the lever 4). The elastically engaging projections 62*a*, 62*b* are elastically displaced in the direction Y to be engaged with the bearing section 5. Grooves 63*a*, 63*b*, 63*c* and a shaft groove 64 are formed in the reinforcement member 6. The grooves 63*a*, 63*b*, 63*c* are configured to avoid the rib 52 when the reinforcement member 6 is mounted in the bearing section 5, and the shaft groove 64 is configured to avoid the shaft 44 supported by the bearing section 5. The groove 63*a* has a wall 633.

As shown in FIGS. 7(*a*)-7(*c*), the reinforcement member 6 may be a mold component made, for example, of an insulating resin material. Alternatively, the reinforcement member 6 may be made of a metal. However, it is preferable that the reinforcement member 6 is made of an insulating resin because there is little possibility of damaging peripheral components such as an insulating cover of the electrical wire W (FIG. 4), and there is no possibility of a short circuit even when an insulating cover of the electrical wire W (FIG. 4) is damaged.

Figure 8B:
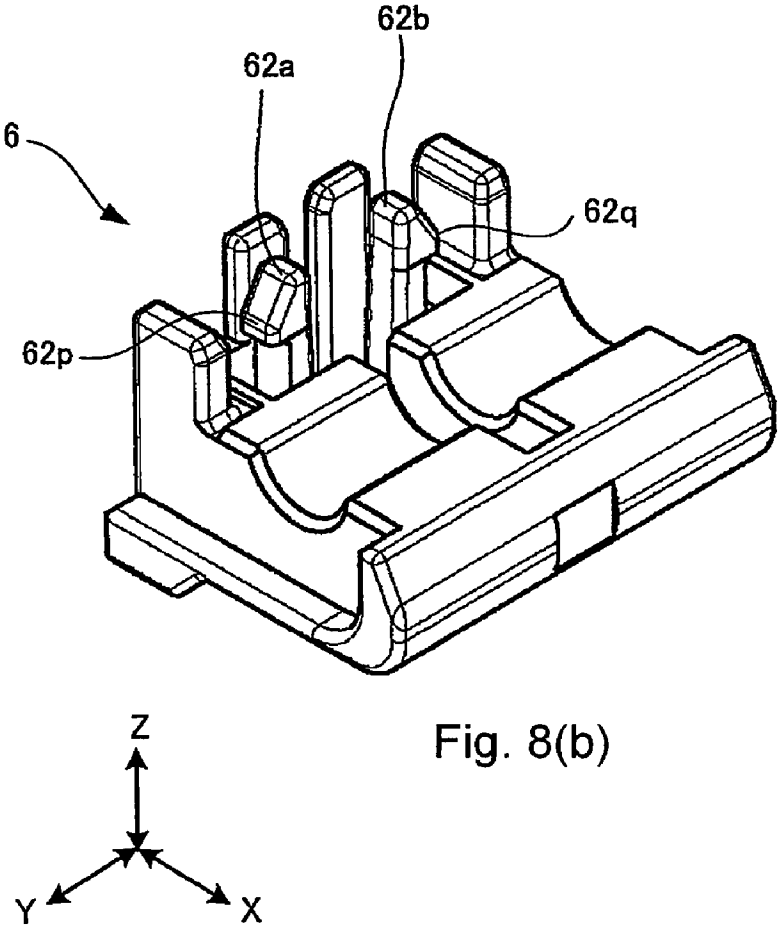
FIG. 8(*a*) is a bottom perspective view of a second embodiment of a reinforcement member of a lever type electrical connector.
Figure 8A:
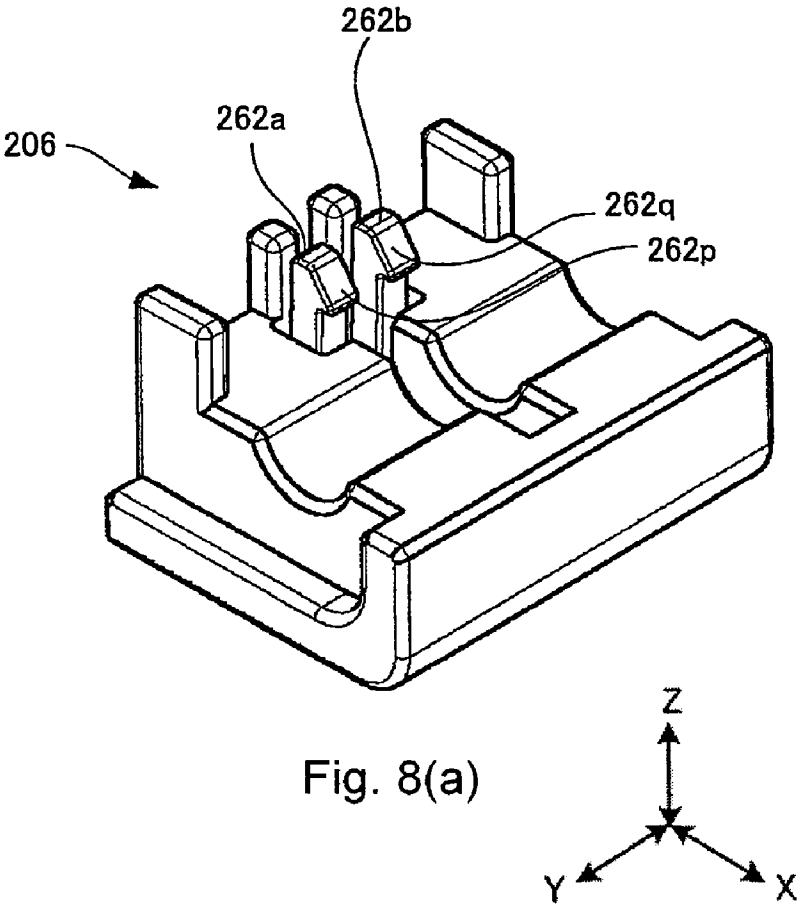

A second embodiment of a reinforcement member 206 is shown in FIG. 8(*a*). A connector for use with the reinforcement member 206 according to the second embodiment is almost same in all portions as the connector 1 used with the reinforcement member 6 according to the first embodiment, except the shape of the elastically engaging projections 62*a*, 62*b* is altered. Therefore, only the differences between the reinforcement member 206 and the reinforcement member 6 will be described.

As shown in FIG. 8(*a*), the reinforcement member 206 includes a pair of elastically engaging projections 262*a*, 262*b* that extend in a substantially up and down in the mating direction Z. The elastically engaging projections 262*a*, 262*b* are arranged substantially in line in the direction Y (direction of the shaft 44 of the lever 4) in a state in which the reinforcement member 206 is mounted in the bearing section 5 (FIG. 1). Lock claws 262*p*, 262*q* are formed at each tip of the elastically engaging projections 262*a*, 262*b*, respectively. The lock claws 262*p*, 262*q* project substantially parallel to the sliding direction X from the elastically engaging projections 262*a*, 262*b*.

As shown FIG. 8(*a*), the lock claws 262*p*, 262*q* are provided on sides of the elastically engaging projections 262*a*, 262*b* in the sliding direction X. It should be noted that, in the reinforcement member 6 according to the first embodiment shown in FIG. 8(*b*), the lock claws 62*p*, 62*q* are provided facing in the direction Y and engaged with the bearing section 5 such that the elastically engaging projections 62*a*, 62*b* are displaced in the direction Y. Accordingly, the engaging amount is increased and the power to hold the reinforcement member 6 against an object that pulls the reinforcement member 6 is raised.

Figure 9:
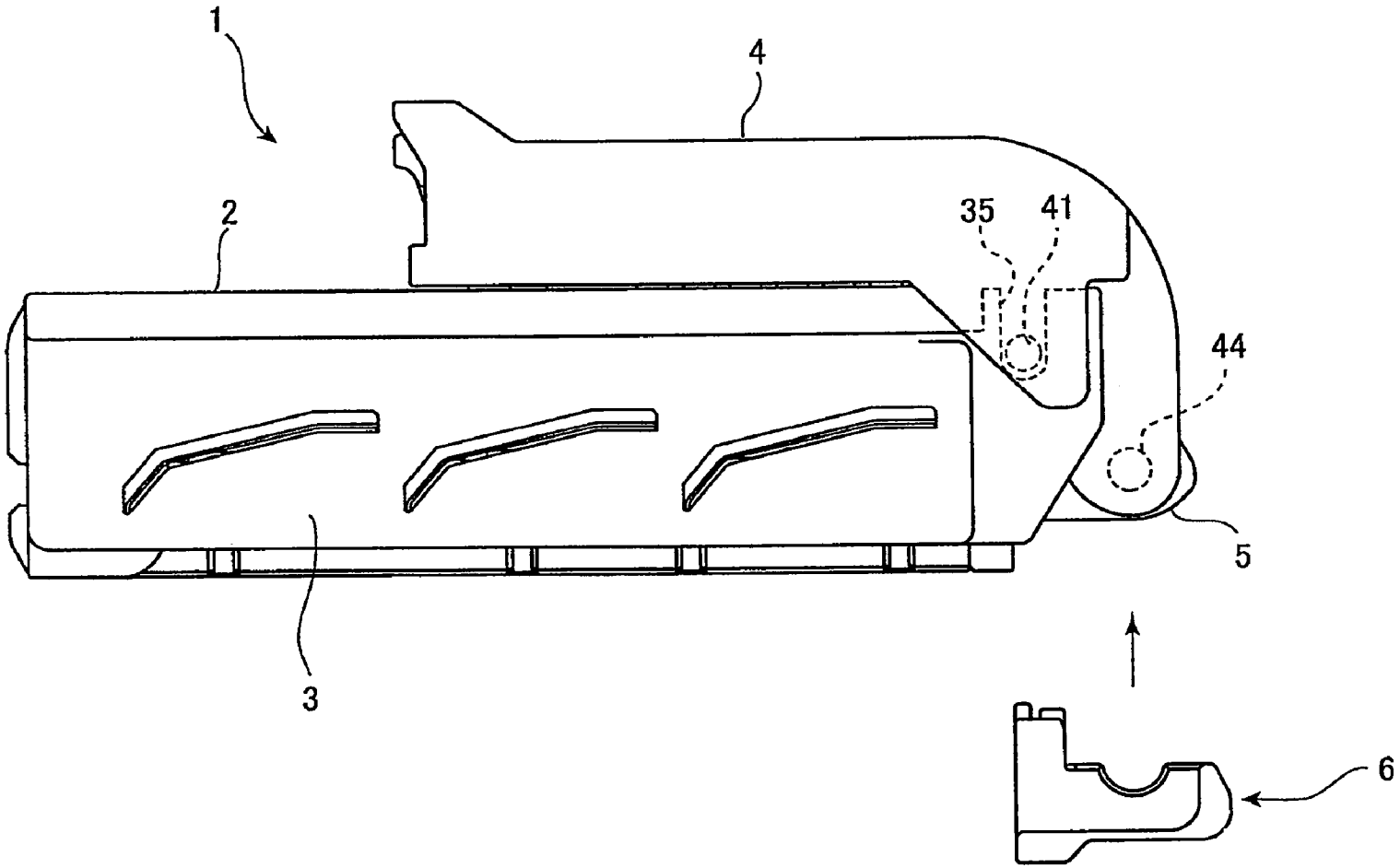
FIG. 9 is an exploded view of the connector of FIG. 1 showing the reinforcement member prior to being mounted in the bearing section.

To assemble the connector 1, the cam plates 3 are mounted on the insulating housing 2, as shown in FIG. 4. Next, the lever 4 is pushed from above into the bearing section 5, as shown in FIG. 9. At this time, the shaft 44 of the lever 4 is held between the first joining section 53 and the second joining section 54 of the bearing section 5 (FIG. 10(*b*)), and the sliding shaft 41 of the lever 4 is engaged in the long groove 35 (FIG. 9). Then, as shown in FIG. 9, the reinforcement member 6 is pushed from below into the bearing section 5.

Figure 10A:
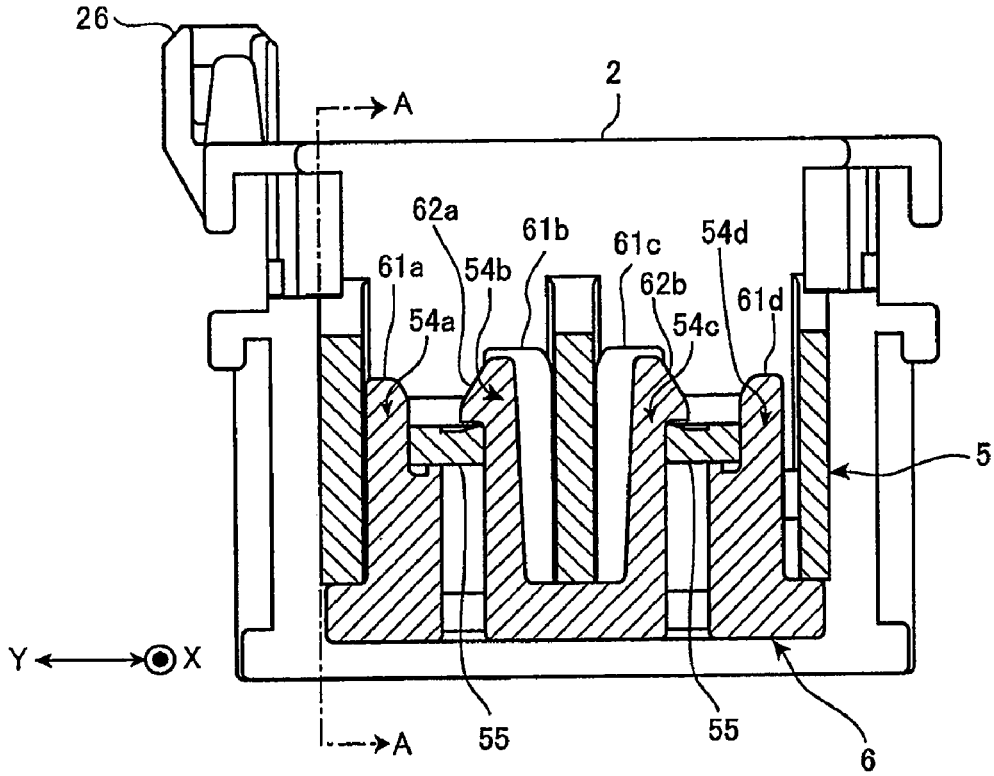
FIG. 10(*a*) is a cross-sectional view of the connector of FIG. 1 showing the reinforcement member mounted in the bearing section with cam plates and the lever omitted.
Figure 10B:
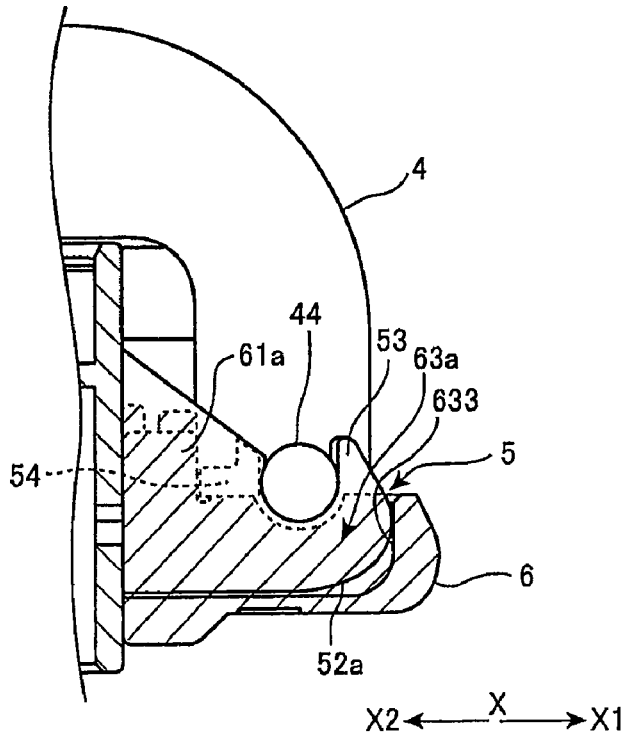

FIG. 10(*a*) shows a cross-section substantially perpendicular to the sliding direction X. FIG. 10(*b*) shows the reinforcement member 6 entirely latched. As shown in FIG. 10(*b*), two directions opposite to each other in the sliding direction X are defined as a rightward direction X1 and a leftward direction X2. In a state in which the reinforcement member 6 is mounted in the bearing section 5, as shown in FIG. 10(*a*), the fixing projections 61*a*, 61*b*, 61*c*, 61*d* are inserted in the openings 54*a*, 54*b*, 54*c*, 54*d*, respectively, and fixed. In addition, the elastically engaging projections 62*a*, 62*b* are inserted in the openings 54*b*, 54*c*, respectively, and are engaged in the assisting joining section 55 so that the reinforcement member 6 is prevented from coming off the bearing section 5. As shown in FIG. 10(*b*), the wall 633 of the groove 63*a* formed in the reinforcement member 6 holds down a tip of the bearing section 5, which projects from the insulating housing 2 in the leftward direction X2. The same logic is similarly applied to the grooves 63*b*, 63*c*. Thus, the reinforcement member 6 prevents the whole of the bearing section 5 including the shaft 44 of the lever 4 from moving in the rightward direction X1.

As shown in FIG. 11, the complementary mating connector 90 is attached to the connector 1 when the lever 4 is in the open position and is inserted halfway into the connector 1. During insertion, the projections 91, 92 fixed to the complementary mating connector 90, which act as cam followers, are guided through the guiding groove 32*c*, 33*c* (FIG. 2) to the cam slots 32, 33, respectively. The lever 4 is the rotated to the closed position by an operator so that the lever 4 pivotally moves around the shaft 44 and applies a force F2 from the shaft 41 to the cam plates 3 in the leftward direction X2 to slide the cam plates 3 in the leftward direction X2 along the sliding direction X. At this time, a force F3 in the rightward direction X1 is applied to the bearing section 5, which acts as a supporting-point. The reinforcement member 6 receives a force in the sliding direction X. The projections 91, 92 receive forces from the cam faces 32*b*, 33*b*, which are both in contact with the projections 91, 92, respectively. As a result, the complementary mating connector 90 is pulled into the insulating housing 2 to complete mating.

When the connector 1 is mated with the complementary mating connector 90, in an irregular engaging state in which mutual positioning adjustment is incomplete or a foreign substance is inserted, the complementary mating connector 90 is not pulled in the insulating housing 2 even though the lever 4 is rotated. In this state, as the lever 4 is forcibly rotated and the force F1 given to the lever 4 increases, the force F3 in the rightward direction X1, which force the bearing section 5 receives from the shaft 44, increases. At this time, since the reinforcement member 6 receives a force which is given from the shaft 44 to the bearing section 5 and prevents the whole of the bearing section 5 including the shaft 44 of the lever 4 from moving in the rightward direction X1, damage to the bearing section 5 is prevented.

When the connector 1 is disconnected from the complementary mating connector 90, the lever 4 is rotated back to the open position. As the lever 4 is rotated, the lever 4 slides the cam plates 3 in the leftward direction X2, and the projections 91, 92 of the complementary mating connector 90 receive forces from the cam faces 32*a*, 33*a*. As a result, the complementary mating connector 90 is separated from the insulating housing 2.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A lever type electrical connector, comprising:

an insulating housing provided with a least one terminal, the insulating housing having a mating face that receives a complementary mating connector;

at least one cam plate arranged on the insulating housing, the cam plate being moveable in a sliding direction substantially perpendicular to a mating direction of the complementary mating connector;

a lever mounted on the insulating housing, the lever having a shaft extending substantially perpendicular to the sliding direction and the mating direction, the lever being rotatable about the shaft between an open position and a closed position to move the cam plate in the sliding direction;

an elastically deformable bearing section provided on the insulating housing that supports the shaft; and a reinforcement member removably attached to the bearing section, the reinforcement member abutting the bearing section such that the reinforcement member receives a force applied from the shaft to the bearing section when the lever is rotated.

2. The lever type electrical connector according to claim 1, wherein the reinforcement member is formed of a resin material.

3. The lever type electrical connector according to claim 1, wherein the bearing section is integrally formed with the insulating housing.

4. The lever type electrical connector according to claim 1, wherein the reinforcement member is separate from the insulating housing.

5. The lever type electrical connector according to claim 1, wherein the bearing section has openings formed therein, and the reinforcement member includes elastically engaging projections that are arranged in the openings, the elastically engaging projections having lock claws that engage with the bearing section.

6. The lever type electrical connector according to claim 5, wherein the lock claws extend substantially parallel to the sliding direction.

7. The lever type electrical connector according to claim 5, wherein the lock claws extend substantially perpendicular to the sliding direction.

8. The lever type electrical connector according to claim 1, wherein the reinforcement member includes a wall that abuts the bearing section to prevent the bearing section from moving in the sliding direction.

9. The lever type electrical connector according to claim 1, wherein the wall that abuts the bearing section to prevent the bearing section and the shaft from moving in the sliding direction.

10. The lever type electrical connector according to claim 1, wherein the shaft is removeable form the bearing section in a direction substantially perpendicular to the sliding direction.

* * * * *